United States Patent [19]

Rhoades

[11] 4,134,517

[45] Jan. 16, 1979

[54] EASY OPEN END

[75] Inventor: John S. Rhoades, Lafayette, Calif.

[73] Assignee: Kaiser Aluminum & Chemical Corporation, Oakland, Calif.

[21] Appl. No.: 830,970

[22] Filed: Sep. 6, 1977

[51] Int. Cl.[2] ..... B65D 41/32

[52] U.S. Cl. ..... 220/268; 220/271

[58] Field of Search ..... 220/265-273; 113/121 C

[56] References Cited

U.S. PATENT DOCUMENTS

| | | | |
|---|---|---|---|
| 3,980,034 | 9/1976 | Delenham et al. | 220/268 X |
| 4,018,178 | 4/1977 | Klein et al. | 220/268 X |

*Primary Examiner*—George T. Hall

*Attorney, Agent, or Firm*—Paul E. Calrow; Frank M. Hansen

[57] ABSTRACT

Improved depressible tab provided with a nose for easy open end closure members and the like, wherein an improved pressure relief means in the form of a unique vent arrangement is incorporated in the nose portion of the depressible tab.

28 Claims, 8 Drawing Figures

EASY OPEN END

BACKGROUND OF THE INVENTION

The instant invention relates to easy open end closure members for containers and the like. More particularly, it is concerned with providing a depressible tab for can end closures that includes a nose portion wherein an improved pressure relief means in the form of a unique vent notch is incorporated in the nose structure of the tab.

Significant problems involved in the construction and use of depressible or push button tabs for beer and effervescent beverage containers and the like concern the controlled relief of internal pressures and the venting of the individual container's contents to the atmosphere during initial opening of the can or container equipped with such tabs so as to avoid undesirable outward spraying and splattering, frothing and foaming of the container's contents.

In an attempt to avoid the aforesaid problems it has been proposed in the past to use a pair of differentially sized openings in a can top which are covered by depressible push buttons, the smaller opening and its associated push button comprising a pressure release and vent opening and the larger opening comprising the pouring opening. The smaller push button is adapted to be opened first because it requires less force. This type of prior art push button or depressible tab container end is illustrated, for example, in U.S. Pat. Nos. 3,902,627; 3,958,717; 3,972,445; 4,033,275; Design Pat. Nos. 226,171 and 233,137 and British Patent Specifications Nos. 1,357,468 of June 19, 1954, and 1,407,806 of Sept. 5, 1975.

It has also been suggested that such prior art small vent openings be incorporated in the principal or large depressible tab structure of an easy open can as evidenced, for example, by the teachings of U.S. Pat. Nos. 3,741,432 and 3,794,206 as well as German Offenlegungsschrift No. 2,421,314 published Nov. 14, 1974. In these instances the smaller depressible tab is adapted to be hingedly connected to the main or larger depressible tab of which it forms a part.

SUMMARY OF THE INVENTION

The instant depressible tab constitutes an improvement over the aforesaid prior art easy open tabs by utilizing a single depressible tab and providing the tab with a unique notched nose portion for controlably relieving the internal pressures generated by the contents of the can or container with which the tab is associated during the initial opening of the container so as to avoid the aforementioned undesirable and sometimes disasterous outward spraying, frothing, foaming and content loss.

The use of a single depressible tab provided with the improved venting arrangement proposed permits use of the same finger element to initiate and subsequently complete the uncovering of the container's pour opening. This is accomplished by the same finger firstly being pressed against the nose portion of the depressible tab to initiate tab and container separation and to expose the pressure release vent notch to the atmosphere. This action can then be followed by a shifting or transfer of force through the medium of the same finger to the main body portion of the tab to obtain full displacement of the tab and a complete uncovering of the pour opening.

In a preferred embodiment of the invention the notched nose portion of the depressible tab can be advantageously provided with ribbed embossments or the like so as to reinforce the notched nose and inhibit malfunctioning of the tab in the initial uncovering of the singular combination pressure release, air vent and pouring opening. In short, structuring of the tab nose portion in this manner helps to concentrate container opening forces in the area of the vent hole or notch during initial tab and container separation while at the same time simplifying the procedures for manufacturing such tabs. The instant tab design also avoids the problems of accidental damage to the small hinge element for the small depressible tabs mounted in or connected to main or large depressible tabs such as are proposed and illustrated in U.S. Pat. Nos. 3,741,432 and 3,794,206 and over which the instant development constitutes an improvement.

The depressible tab of the instant invention also constitutes an improvement over the single depressible tabs of U.S. Pat. Nos. 3,982,657; 3,980,034; 2,261,117; 3,905,513; 1,878,677; 3,881,437 and 3,843,011, as well as the other depressible tab developments of U.S. Pat. Nos. 3,410,436; 3,779,417; 3,760,752; 3,886,199; 3,334,775; 4,006,700; 3,286,874; 3,931,909; 4,018,178 and Design Pat. No. 208,591.

A preferred embodiment of the invention contemplates that during manufacture at least the nose portion of the depressible tab be completely severed from the end closure panel per se with which it is associated. This permits the nose portion which can comprise a small or large section of the tab to be advantageously overlapped and locked in position by the end closure panel either by virtue of flattening and expanding at least the nose part of the tab in the manner disclosed in U.S. Pat. No. 4,033,275 or by shrinking the end closure opening about at least the nose of the tab in the manner discussed in U.S. Pat. No. 3,931,909. After the desired selected overlapping of tab nose and panel has been completed the line of severance between the end closure panel and the tab nose portion is subsequently sealed by the application of an appropriate plastic sealant patching material in the manner noted, for example, in U.S. Pat. No. 3,931,909, such as by means of a plastisol material sold under the designation "Plastisol 911" by the Dewey and Almy Chemical Division of W. R. Grace and Company of San Leandro, California.

In the ensuing discussion it is to be understood that the terms "closure member" or "end closure" as used throughout the specification and claims are meant to include closures made from various types of appropriate material such as aluminum and its alloys, steel, tin plate, and other metals which are suitable for manufacturing the container closures as well as container closures made of these metals provided with relatively thin plastic films and coatings well known in the art and customarily used to protect the closure metal against the contents of the containers and vice versa and container closures of other than circular configurations.

BRIEF DESCRIPTION OF DRAWINGS

FIG. 6(*a*) is a view similar to FIG. 6 after the bulged tab hinge portion has been flattened to enhance the overlap between the nose portion of the tab and the panel area surrounding the tab opening;

DETAILED DESCRIPTION

Figure 1:
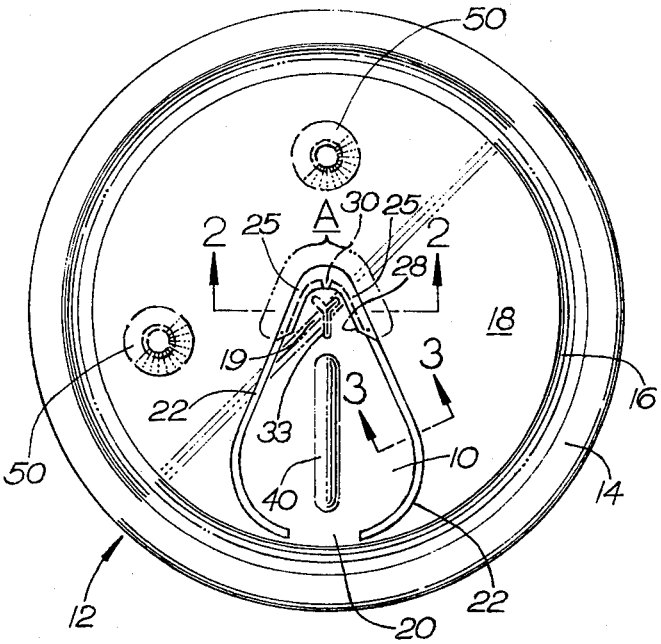
FIG. 1 is a top plan view of a container end closure provided with the improved depressible tab of the instant invention.
Figure 2:
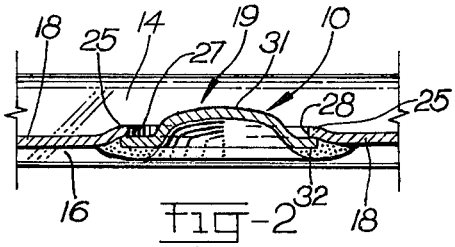
FIG. 2 is a partial cross-sectional view of the container end closure of FIG. 1 when taken along the line 2—2 thereof and with a modified form of nose reinforcement being shown.

With further reference to the drawings and in particular FIGS. 1 through 4, one embodiment of the invention contemplates that the depressible tab 10 would be utilized with an end closure 12 made of a suitable aluminum alloy, e.g., 5182, the number designated for the same by the American Aluminum Association and of the proper temper and with an original thickness of about 0.013 inch. Each closure 12 is provided with the standard outer peripheral reinforcing rim 14 which is adapted to be lock-seamed in the usual fashion to the top of a container such as a beverage or beer container. Closure 12 further includes the usual reinforcing rib or counter sink 16 and a central or main panel or area 18.

Tab 10 can take various configurations or shapes such as the teardrop shape of the drawings, or it can be rectangular, oblong or elliptical, etc. Tab 10 includes the normal hinge section 20 that can be small as indicated in drawings or it can be larger. This hinge section can also be located in close proximity or adjacent to the counter sink 16. Hinge section 20 is formed integrally with the main panel 18 and serves to retain depressible tab in contact with the panel after it has been depressed the desired amount.

Figure 3:
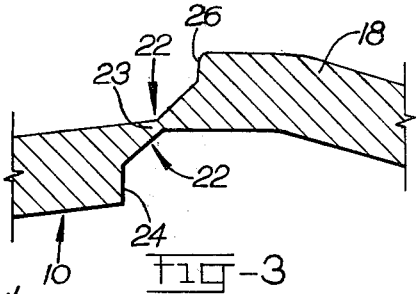
FIG. 3 is an enlarged cross-sectional view of a portion of the container end closure of FIG. 1 when taken along line 3—3 thereof.

Score lines 22 eminate from opposite sides of the hinge 20 and these score lines may be simple score lines impressed on one side of the end closure 12 or they may take the form of the double scores shown in FIG. 3 wherein the scoring takes place on both sides of the end closure 12 and as shown in U.S. Pat. Nos. 3,902,627 and 3,982,657. Thus the tab is further delineated by a thinned and embrittled area or web 23 defined by the score lines 22 and bounded on each side by the stepped portion 24 of the tab and the stepped portion 26 of the main panel 18. Embrittled section 22 can be readily fractured to complete the final separation of tab 10 from the remainder of the panel 18 except for hinge portion 20 once the opening of the depressible tab is initiated as set out hereinafter. The weakened webs or scored areas 23 project for a preselected distance away from and on both sides of hinge 20 until they tend to converge such as adjacent the central axis of the panel 18 and merge with notched nose portion 19 of tab 10.

Nose portion 19 is formed in the sector A of the panel 18 of FIG. 1 by being first completely severed from panel 18 in this sector A and then being overlapped by the portions 25 of the panel 12 located adjacent to or defining the line of severance between the panel and nose portion. This overlapping can be effected by forming a bulge in the tab nose and then pushing the tab nose down into the opening and subsequently expanding the nose 19 in the manufacturing process in the manner described in U.S. Pat. No. 4,033,275; or by pushing the tab nose down into the opening 27 formed by severance of the nose from the panel 12 and then collapsing or stretching the overlapping portion 25 of the panel surrounding and defining opening 27 to shrink the size of opening 27 in the manner discussed in U.S. Pat. No. 3,931,909.

Nose 19 is provided with the unique venting notch or opening 30 and although only one such notch, which can be V-shaped, is shown it is obvious that other notch configurations or cuts may be employed as well as multiple notches. The nose 19 may be advantageously stiffened and reinforced by suitable embossments such as by means of the finger engaging button 31 of FIG. 2 or the Y-shaped ribbing 33 of FIGS. 1, 4 and 8.

After tab nose portion 19 is selectively overlapped by panel opening surround or free edge 28 of panel portions 25 to the point that the notch 30 is preferably fully covered by the overlapping metal of panel portions 25 it can be sealed in place. The underlying part of nose 19 is sealed to the end closure 12 by the application of a sufficient amount of plastisol sealant patching material 32 of the type previously described to the area of overlap and severance between nose 19 and panel 18 whereby a substantially complete seal is effected between tab and panel and with notch 30 being preferably completely filled with the sealant material to minimize accidental opening and venting of the end closure until the desired time.

Figure 4:
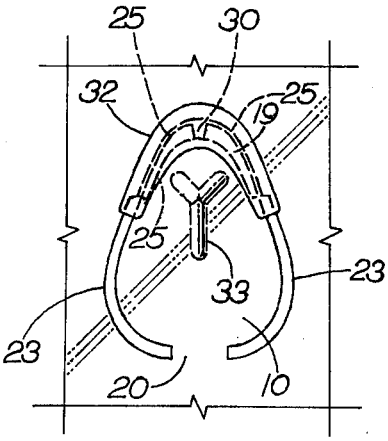
FIG. 4 is a fragmentary bottom plan view with parts removed and other parts added of the portion of the sealant covered underside of the container end closure of FIG. 1 that contains the depressible tab and with the severed and tab overlapping panel portions being shown in dotted lines, with the tab being somewhat reduced in size and provided with modified embossments from that shown in FIG. 1.
Figure 8:
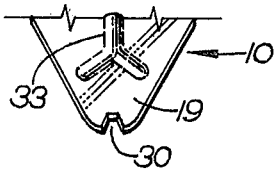
FIG. 8 is a fragmentary perspective view of the reinforced and notched nose portion that can be used with the depressible tab of FIG. 1.

If desired, the excess metal resulting from forming the thinned web 23 can be advantageously absorbed in a further reinforcing embossment 40 of the type shown in FIG. 1 or in an extension of the base leg of the Y-shaped embossment 33 shown in FIGS. 1, 4 and 8.

It is to be understood that the embossments 31, 33 and 40 should be of such an appropriate height that they still would be protected by the rim 14 of the end closure even when rim 14 is partially collapsed and seamed to a can. As further protection for tab 10 and the embossments thereof additional appropriate upstanding embossments 50 only two of which are shown in FIG. 1 can be formed in panel 18. These latter embossments 50 are used to protect the tab and prevent accidental opening of the same during the usual seaming of the end closure 12 to a metal container such as a beer or beverage can as well as during a further end closure mechanical handling and stacking operation.

Figure 5:
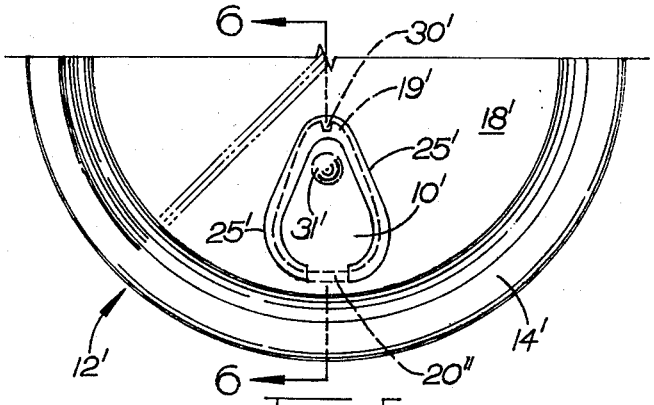
FIG. 5 is a fragmentary top plan view of another container end closure and discloses a further embodiment of the depressible tab of the instant invention.
Figure 6:
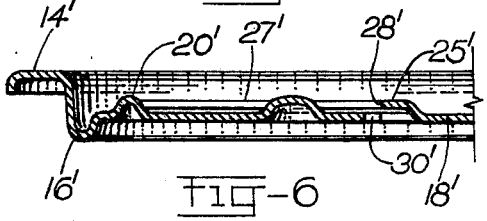
FIG. 6 is a fragmentary cross-sectional view of the end closure of FIG. 5 when taken along line 6—6 thereof and illustrates a step that can be used, if desired, in the production process for the tab of FIG. 5 wherein the hinge portion of the tab is first bulged outward.
Figure 6A:
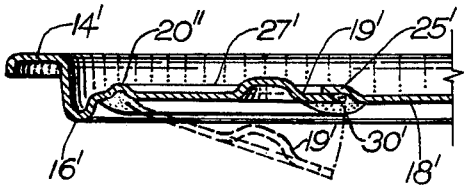
Figure 7:
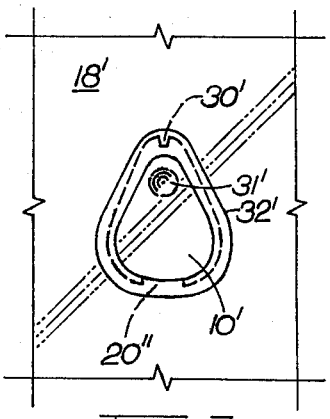
FIG. 7 is a fragmentary bottom plan view of the portion of the sealant covered underside of the end closure of FIG. 5 that contains the depressible tab and illustrates how an endless ring of sealant material covers the line of demarkation or separation between the main panel of the end closure and the depressible tab per se as well as the tab hinge.

A further advantageous embodiment of the invention is disclosed in FIGS. 5 through 7. In this instance prime numerals are used to identify parts similar to those of FIGS. 1 through 4. Thus the depressible tab 10′ can likewise have a somewhat teardrop shape with the hinge portion 20′ integral with panel 18′ also being preferably located in close proximity to the counter sink 16′. Except for hinge portion 20′ tab 10′ is completely and continuously severed from panel 18′ along the free surround edge 28° which merges with the hinge portion 20′ at the opposing extremities thereof. The severed tab can then be pushed through the opening 27′ formed by the severance of tab 10′ from panel 18′ and expanded or enlarged in the manner described in U.S. Pat. No. 4,033,275 to form the desired overlap between tab 10′ and panel 18′ along the periphery of the tab 10′ and the overlapping panel portions 25′ extending from hinge 20′. Alternatively the overlap of the tab 10′ and panel 18′ can be effected as in the case of the tab nose of FIG. 1 by the manufacturing steps described in U.S. Pat. No. 3,931,909 which includes the step of reducing the size of closure opening 27′ by collapsing or stretching the overlapping panel portions 25′ of panel 18′ surrounding the opening 27′. In any event regardless of how the overlap of tab 10′ and panel 18′ is effected it should preferably be sufficient at nose portion 19′ to substantially fully cover the vent notch 30′ formed in the nose portion 19′ during manufacture on one side of panel 18′.

As in the case of the tab 10′ of FIG. 1, a line of sealant 32′ is then applied to the other or underside of panel 18′ and along the entire periphery of the tab 10′ including, if desired and as indicated in FIG. 7, the hinge portion 20′. Thus the sealant can be applied as a full unbroken ring of sealant having the appropriate width and thickness. This sealant also preferably fills the notch 30′ of nose 19′ in the same fashion as with the tab of FIG. 1 to form a final positive seal between tab 10′ and panel 18′ until the tab is depressed by the application of pressure first to the nose portion 19′ to effect initial fracture of the sealant in the area of the nose portion 19′ along with the initial separation of panel 18′ and tab 10′ and a controlled release of the interior pressure of the container provided with the tab. If desired, the tab 10′ of FIG. 5 can also have the same notch features and nose reinforcements as those of the tab 10 of FIG. 1.

In a further advantageous embodiment of the invention and as indicated particularly in FIGS. 6 and 6(*a*) in those instances where the tab 10′ is fully severed from the panel 18′ except in the hinge area 20′ this hinge area on the panel 18′ can be somewhat bulged in the manner indicated in U.S. Pat. No. 3,980,034 during the initial steps of tab and panel severance and notching of the nose portion in the manufacturing operation. Thereafter this bulged area of the panel 18′ is flattened or collapsed into the final hinge 20″ and upon flattening forces the notched nose 19′ to be additionally selectively overlapped in the offset manner shown in FIG. 6(*a*) to obtain an extended overlap and seal between panel 18′ and nose 19′.

While FIGS. 1, 4 and 8 disclose how the bifurcated nose portion 19 of the tabs of FIGS. 1 and 4 can be reinforced or stiffened to insure initial fracture of the sealant and controlled release of pressure in the area of the nose portion of a depressible tab by Y-shaped ribbing, it is to be understood that such ribbing could be extended to the edges of the nose 19 if desired. Finally, depending on the particular configuration adapted for the depressible tab and the results desired the tab can be so oriented on an end closure panel 18 or 18′ such that the hinge portion 20 or 20″ of the tab is located remote from the counter sink or rim portion of the end closure rather than adjacent thereto and the notched nose portion located adjacent the center of the panel 18 or the most neutral point on the panel should a can provided with the instant tab be tilted during opening.

In those instances where during tab manufacture only the nose portion of the tab is completely severed from the end closure panel while the remainder of the tab periphery exclusive of the tab hinge is defined by a score line as in the case of the tabs of FIGS. 1 and 4, care should be exercised to provide for the desired tab force advantage to initiate tab and sealed panel separation without great difficulty. Thus a preferred embodiment of the invention contemplates in the aforesaid instances that the full panel and tab severance line in the sector A comprise between about one-fourth and one-third of the overall outer periphery of the tab exclusive of the hinge portion thereof.

Advantageous embodiments of the invention have been shown and described. It is obvious that various changes may be made therein without departing from the spirit and scope thereof as defined by the appended claim wherein:

What is claimed is:

1. An easy open closure member for a container comprised of a panel means and a depressible tab provided with a hinge portion formed integrally with said panel means and a relatively stiff nose portion that includes a pressure relief notch means spaced from said hinge portion, said nose portion being severed from and selectively overlapped by said panel means, sealant patching material covering the underside of said panel means in the area of severance of said nose portion and said panel means for effecting a seal between said panel means and said depressible tab nose portion and means retaining the remaining peripheral portions of the tab intermediate the hinge portion and nose portion in a predetermined closed position relative to the panel means.

2. An easy open closure member as set forth in claim 1 wherein said tab has an elongated configuration with the main axis of said tab extending in a radially outward direction from the center of the panel means.

3. An easy open closure member as set forth in claim 1 wherein said last mentioned means comprises continued severances of the tab from and continued selective overlapping of the tab by said panel means and a continuation of the sealant patching material covering the underside of said panel means in the area of said severances whereby said tab is completely severed from said panel means except at the hinge portion thereof.

4. An easy open closure member as set forth in claim 1 wherein said last mentioned means comprises score lines in said panel means.

5. An easy open closure member as set forth in claim 1 including a finger engagable embossment at least on the nose portion of the tab.

6. An easy open closure member as set forth in claim 1 including rib means disposed on each side of the notch means on said nose portion.

7. An easy open closure member as set forth in claim 1 wherein the notch means is fully overlapped by the panel means and covered by the sealant patching material.

8. An easy open closure member as set forth in claim 1 wherein the hinge portion is located adjacent the outer peripheral portion of the panel means.

9. An easy open closure member as set forth in claim 1 wherein said last mentioned means comprises continued severances of the tab from and continued selected overlapping of the tab by said panel means and a continuation of the sealant patching material covering the underside of said panel means in the area of said continued severances and said notch means being fully overlapped by the panel means as well as being covered by the sealant patching material.

10. An easy open closure member as set forth in claim 1 wherein said last mentioned means comprises frangible score lines in said panel means and said notch means being fully overlapped by the panel means as well as being covered by the sealant patching material.

11. An easy open closure member as set forth in claim 3 wherein the hinge portion of the tab comprises a portion of the panel means that has been collapsed and flattened to increase the degree of overlap of the nose portion by said panel means.

12. An easy open end closure for a container comprised of a main panel encompassed by a rim and a counter sink portion together with a depressible tab provided with a hinge portion formed integrally with the main panel and a relatively stiff nose portion that includes a pressure release notch means spaced from said hinge portion, at least the nose portion of said tab being severed from and selectively overlapped by said panel, sealant patching material covering the underside of said panel in the area of severance of said nose portion and said panel for effecting a seal between said panel and said depressible tab nose portion and means retaining the remaining peripheral portions of the tab intermediate the hinge portion and nose portion in a predetermined closed position on the panel.

13. The easy open end closure as set forth in claim 12 wherein the hinge portion is located adjacent the counter sink portion and the notch means of the nose portion is located adjacent the center of the panel.

14. The easy open end closure as set forth in claim 12 wherein the tab has an elongated configuration with the main axis of said tab extending in a radially outward direction from the center of the panel.

15. The easy open end closure of claim 12 wherein said last mentioned means comprises frangible score lines on the panel.

16. The easy open end closure of claim 12 wherein said last mentioned means comprise continued severances of the tab from the panel along with selective overlapping of the peripheral portions of the tab by said panel and a continuation of the sealant patching material covering the underside of said panel in the area of said continued severances.

17. The easy open end closure of claim 12 including tab reinforcing rib means portions of which extend into said nose portion.

18. The easy open end closure of claim 12 wherein the notch means is fully overlapped by a portion of the panel on one side of the nose portion and completely covered by the sealant patching material on the other side of the nose portion.

19. The easy open end closure of claim 12 wherein the hinge portion comprises a part of the panel that has been collapsed and flattened to increase the overlap of the nose portion by the panel.

20. The easy open end closure of claim 14 wherein the notch means of the nose portion is fully overlapped by a portion of the panel on one side of the nose portion and completely covered by sealant patching material on the other side of the nose portion.

21. The easy open end closure of claim 14 wherein the notch means of the nose portion is located adjacent the center of the panel.

22. The easy open end closure of claim 15 wherein the notch means is fully overlapped by a portion of the panel on one side of the nose portion and completely covered by sealant patching material on the other side of the nose portion.

23. An easy open closure member as set forth in claim 1 wherein the severance line between the nose portion and said panel means comprises between about one-fourth and one-third of the overall periphery of the tab exclusive of the hinge portion thereof.

24. An easy open closure member as set forth in claim 4 wherein the severance line between the nose portion and said panel means comprises between about one-fourth and one-third of the overall periphery of the tab exclusive of the hinge portion thereof.

25. An easy open end closure as set forth in claim 12 wherein the severance line between the nose portion and said panel comprises between about one-fourth and one-third of the overall periphery of the tab exclusive of the hinge portion thereof.

26. An easy open end closure as set forth in claim 15 the severance line between the nose portion and said panel comprises between about one-fourth and one-third of the overall periphery of the tab exclusive of the hinge portion thereof.

27. An easy open closure member for a container comprised of a panel means and a depressible tab provided with a hinge portion formed integrally with said panel means and a relatively stiff nose portion that includes a pressure relief notch means, at least a part of said nose portion being spaced from said hinge portion, said nose portion being severed from and selectively overlapped by said panel means, sealant patching material covering the underside of said panel means in the area of severance of said nose portion and said panel means for effecting a seal between said panel means and said depressible tab nose portion and means retaining the remaining peripheral portions of the tab intermediate the hinge portion and nose portion in a predetermined closed position relative to the panel means.

28. The easy open closure member of claim 27 wherein the notch means of the nose portion is located adjacent the center of the panel means.

* * * * *

UNITED STATES PATENT AND TRADEMARK OFFICE

CERTIFICATE OF CORRECTION

PATENT NO. : 4,134,517

DATED : January 16, 1979

INVENTOR(S) : John S. Rhoades

It is certified that error appears in the above-identified patent and that said Letters Patent are hereby corrected as shown below:

Column 3, line 43, "Each closure 12" should be

--End closure 12--

Column 5, line 7, "28°" should be --28'--

Signed and Sealed this

Fifth Day of June 1979

[SEAL]

Attest:

RUTH C. MASON
*Attesting Officer*

DONALD W. BANNER
*Commissioner of Patents and Trademarks*